US010322487B1

(12) United States Patent
Hansen et al.

(10) Patent No.: US 10,322,487 B1
(45) Date of Patent: Jun. 18, 2019

(54) ROLLER MILL GRINDING APPARATUS WITH REGENERATIVE CAPABILITY

(71) Applicant: PEARSON INCORPORATED, Sioux Falls, SD (US)

(72) Inventors: Nick Hansen, Sioux Falls, SD (US); Roy Olson, Soiux Falls, SD (US)

(73) Assignee: Pearson Incorporated, Sioux Falls, SD (US)

( * ) Notice: Subject to any disclaimer, the term of this patent is extended or adjusted under 35 U.S.C. 154(b) by 0 days.

(21) Appl. No.: 15/648,629

(22) Filed: Jul. 13, 2017

Related U.S. Application Data

(60) Provisional application No. 62/362,615, filed on Jul. 15, 2016.

(51) Int. Cl.

| | |
|---|---|
| ***B24B 1/00*** | (2006.01) |
| ***B24B 7/12*** | (2006.01) |
| ***B24B 49/10*** | (2006.01) |
| ***B24B 5/37*** | (2006.01) |
| ***B21B 28/04*** | (2006.01) |
| ***B24B 41/02*** | (2006.01) |

(52) U.S. Cl.
CPC ..... *B24B 5/37* (2013.01); *B21B 28/04* (2013.01); *B24B 1/00* (2013.01); *B24B 1/002* (2013.01); *B24B 7/12* (2013.01); *B24B 41/02* (2013.01); *B24B 49/10* (2013.01)

(58) Field of Classification Search
CPC .. B24B 1/00; B24B 1/002; B24B 7/12; B24B 41/02; B24B 49/00; B24B 49/10
USPC ..... 451/10, 11, 49, 194, 907
See application file for complete search history.

(56) References Cited

U.S. PATENT DOCUMENTS

| | | | |
|---|---|---|---|
| 254,974 | A | 3/1882 | Hollingsworth |
| 417,836 | A | 12/1889 | Ponsar |
| 454,950 | A | 6/1891 | Sewell |
| 473,957 | A | 5/1892 | Pollock |
| 621,744 | A | 3/1899 | Bowden |
| 664,836 | A | 1/1901 | Davidson |
| 738,166 | A | 9/1903 | Davidson |
| 1,466,508 | A | 8/1923 | Lake |

(Continued)

FOREIGN PATENT DOCUMENTS

| | | |
|---|---|---|
| CN | 207385669 | 5/2018 |
| DE | 102005055373 | 5/2007 |

(Continued)

OTHER PUBLICATIONS

Charles Stark and Julie Kalivoda, "Evaluating Particle Size of Feedstuffs", publication, Nov. 2016, 4 pages, K-State Research and Extension, Kansas State University Agricultural Experiment Station and Cooperative Extension Services, Manhattan, Kansas.

*Primary Examiner* — Eileen P Morgan
(74) *Attorney, Agent, or Firm* — Jeffrey A. Proehl; Woods, Fuller, Shultz & Smith, PC

(57) ABSTRACT

A roll grinding apparatus may comprise a frame, first and second rolls rotatably mounted on the frame in proximity to each other to grind materials passing between the rolls, and first and second motors to rotate the first and second rolls respectively. A control apparatus controls operation of at least one of the motors. The control apparatus may be configured to control the speed of the second roll by providing power to the second motor or braking the second motor through regeneration of energy from the second motor.

18 Claims, 6 Drawing Sheets

(56) References Cited

U.S. PATENT DOCUMENTS 1,568,267 A 1/1926 Carter
1,611,675 A 12/1926 Prestmon
2,053,038 A 9/1936 MacKenzie
2,118,010 A 5/1938 Hazle, Jr.
3,226,041 A 12/1965 Graumann
3,304,355 A 2/1967 Pobst, Jr.
3,362,649 A 1/1968 Odden
3,683,559 A * 8/1972 Kalwaites ..... B24B 19/223 26/1
3,752,315 A 8/1973 Hubach
4,165,280 A 8/1979 Holley
4,177,900 A 12/1979 Kluthe
4,202,629 A 5/1980 Jakobs
4,213,855 A 7/1980 Vonbennigsen-Mackiewicz
4,361,476 A 11/1982 Brewer
4,387,552 A * 6/1983 Lancaster ..... A01F 15/071 53/211
4,442,876 A * 4/1984 Koike ..... B27D 1/005 144/2.1
4,468,265 A 8/1984 MacLaughlin
4,608,156 A 8/1986 Reddish
4,645,484 A * 2/1987 Niske ..... B24B 1/00 451/182
4,786,001 A 11/1988 Ephraim
4,862,570 A * 9/1989 Bald ..... B21B 45/06 29/81.03
4,941,290 A * 7/1990 Holyoke ..... B24B 7/12 451/182
4,986,997 A 1/1991 Posner
5,052,088 A * 10/1991 Hagewood ..... B65H 59/36 28/172.1
5,100,062 A * 3/1992 Baltensperger ..... B02C 4/06 241/9
5,115,984 A 5/1992 Satake
5,192,028 A 3/1993 Curran
5,201,470 A 4/1993 Baltensperger
5,251,144 A 10/1993 Ramamurthi
5,315,789 A 5/1994 Takashi
5,366,167 A 11/1994 McCarthy
5,392,998 A 2/1995 Suessegger
5,501,629 A * 3/1996 Kawana ..... B24B 7/12 451/178
5,523,701 A 6/1996 Smith
5,533,371 A 7/1996 Frischknecht
5,717,209 A 2/1998 Bigman
6,176,683 B1 1/2001 Yang
6,199,777 B1 3/2001 Satake
6,293,478 B1 * 9/2001 Livrieri ..... B02C 4/06 241/11
6,365,416 B1 4/2002 Elsohly
6,372,281 B1 4/2002 Metzger
6,443,376 B1 9/2002 Huang
6,517,016 B1 2/2003 Feige
6,589,598 B2 * 7/2003 Ochiai ..... B05C 1/025 118/114
6,730,519 B2 5/2004 Elsohly
6,990,431 B2 1/2006 Beaudoin
7,006,953 B2 2/2006 Takemura
7,083,544 B2 8/2006 Goransson
7,170,251 B2 1/2007 Huang
7,183,735 B2 2/2007 Heinemann
7,206,719 B2 4/2007 Lindsay
7,381,017 B2 6/2008 Wang
7,419,694 B2 9/2008 Korolchuk
7,425,344 B2 9/2008 Korolchuk
7,540,697 B2 1/2009 Wang
7,568,641 B2 8/2009 Dreimann
7,592,468 B2 9/2009 Goodwin
7,756,678 B2 7/2010 Bonissone
7,832,241 B2 11/2010 Mantovan
8,144,005 B2 3/2012 Hu
8,206,061 B1 6/2012 Hansen
8,211,341 B2 7/2012 Lustiger
8,343,553 B2 1/2013 Hospodor
8,485,052 B2 7/2013 Gebhart
8,690,087 B2 4/2014 Holl
8,734,143 B2 5/2014 Morris
8,842,267 B2 9/2014 Heine
9,066,910 B2 6/2015 Rosenblatt
9,104,650 B2 8/2015 Hosek
9,604,226 B2 3/2017 Storm
9,649,349 B1 5/2017 Tucker
9,651,467 B2 5/2017 Deguchi
9,694,040 B2 7/2017 Scialdone
9,788,770 B1 10/2017 Belthangady
9,795,338 B2 10/2017 Kang
9,797,822 B2 10/2017 Little, III
9,801,956 B2 10/2017 Kularatne
9,803,063 B2 10/2017 Reddy
9,804,092 B2 10/2017 Zeng
9,808,538 B2 11/2017 Kularatne
9,919,315 B2 3/2018 Pearson
9,959,514 B2 5/2018 Phan
9,974,821 B2 5/2018 Kennedy
2002/0022899 A1 2/2002 Dehy
2002/0168911 A1 11/2002 Tonner
2003/0017426 A1 1/2003 Schmidt
2004/0096585 A1 * 5/2004 Bonnebat ..... B05C 1/083 427/318
2006/0073258 A1 4/2006 Korolchuk
2006/0231021 A1 * 10/2006 Friske ..... B05C 11/041 118/261
2007/0170291 A1 7/2007 Naganawa
2007/0294121 A1 12/2007 Galt
2008/0063330 A1 3/2008 Orlowski
2008/0167483 A1 7/2008 Whittle
2008/0203956 A1 8/2008 Cohen
2008/0275660 A1 11/2008 Bhateja
2009/0093191 A1 4/2009 Glide
2009/0295561 A1 12/2009 Hu
2010/0030926 A1 2/2010 Boussy
2010/0059609 A1 3/2010 Teeter
2010/0127217 A1 5/2010 Lightowlers
2011/0067374 A1 3/2011 James
2011/0276828 A1 11/2011 Tamaki
2012/0005017 A1 1/2012 Lowden
2012/0244266 A1 9/2012 Ku
2013/0087644 A1 4/2013 Ephraim
2013/0271110 A1 10/2013 Yamanaka
2013/0301375 A1 11/2013 Stephan
2014/0014748 A1 1/2014 Zeeck
2014/0048459 A1 2/2014 Hafford
2014/0145018 A1 5/2014 Niklewski
2014/0245799 A1 9/2014 Kim
2014/0299688 A1 10/2014 Carbonini
2015/0129698 A1 5/2015 Olson
2015/0211971 A1 7/2015 Little, III
2015/0300800 A1 10/2015 Van Valkenburgh
2015/0324759 A1 11/2015 Bansal
2015/0346717 A1 12/2015 Hosek
2017/0080466 A1 * 3/2017 Godwin ..... B21B 37/16
2017/0131194 A1 5/2017 Little, III
2017/0333257 A1 * 11/2017 Schmitz ..... A61F 13/15577

FOREIGN PATENT DOCUMENTS

EP 1195668 9/2002
JP 2010201440 9/2010
WO 2005119089 12/2005
WO 2007066847 6/2007
WO 2010082322 7/2010
WO 2017051398 3/2017

* cited by examiner

ROLLER MILL GRINDING APPARATUS WITH REGENERATIVE CAPABILITY

REFERENCE TO RELATED APPLICATIONS

This application claims the benefit of the filing of U.S. Provisional Application No. 62/362,615, filed Jul. 15, 2016, which is hereby incorporated by reference in its entirety.

BACKGROUND

Field

The present disclosure relates to roller mill grinding apparatus and more particularly pertains to a new roller mill grinding apparatus with regenerative capability for controlling rotation speeds of rolls in the apparatus while recovering some of the energy expended during operation.

SUMMARY

The present disclosure relates to a roll grinding apparatus comprising a frame, a first roll and a second roll mounted on the frame and positioned in spaced proximity to each other to grind materials passing through a gap between the rolls, and a first motor configured to rotate the first roll and a second motor configured to rotate the second roll. The apparatus may also comprise a control apparatus in communication with at least one of the first and second motors to control operation of at least one of the motors through control of supply of electrical power to the at least one motor. The control apparatus may be configured to determine a first target speed for the first roll and a second target speed for the second roll, sense a current speed of the second roll, compare the current speed to the second target speed, and cause the second motor to rotate the second roll at the second target speed by:

if the current speed is lower than the second target speed, increasing an amount of electrical power provided to the second motor to increase the current speed of the second roll; and if the current speed is higher than the second target speed, decreasing an amount of electrical power provided to the second motor such that the second roll drives rotation of the second motor to cause the second motor to generate electrical power and function as a brake on rotation of the second roll and decrease the current speed of the second roll.

In another aspect, the disclosure relates to a method of operating a roll grinding apparatus having a frame, a first roll and a second roll rotatably mounted on the frame and positioned in proximity to each other to grind materials passing through a gap spacing between the rolls, a first motor configured to rotate the first roll and a second motor configured to rotate the second roll, and a control apparatus in communication with each of the first and second motors to control operation of the motors through control of supply of electrical power to the motors. The method may comprise determining a target speed for each of the first and second rolls, operating the first roll by supplying electrical power to the first motor, sensing a current speed for the second roll, and comparing the current speed for the second roll to the target speed for the second roll. The method may also include adjusting the speed of the second roll by:

if the current speed of the second roll is lower than the second target speed, increasing an amount of electrical power provided to the second motor to increase the current speed of the second roll; and if the current speed of the second roll is higher than the second target speed, decreasing an amount of electrical power provided to the second motor such that the second roll drives rotation of the second motor to cause the second motor to generate electrical power and function as a brake on rotation of the second roll and decrease the current speed of the second roll.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, as well as the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
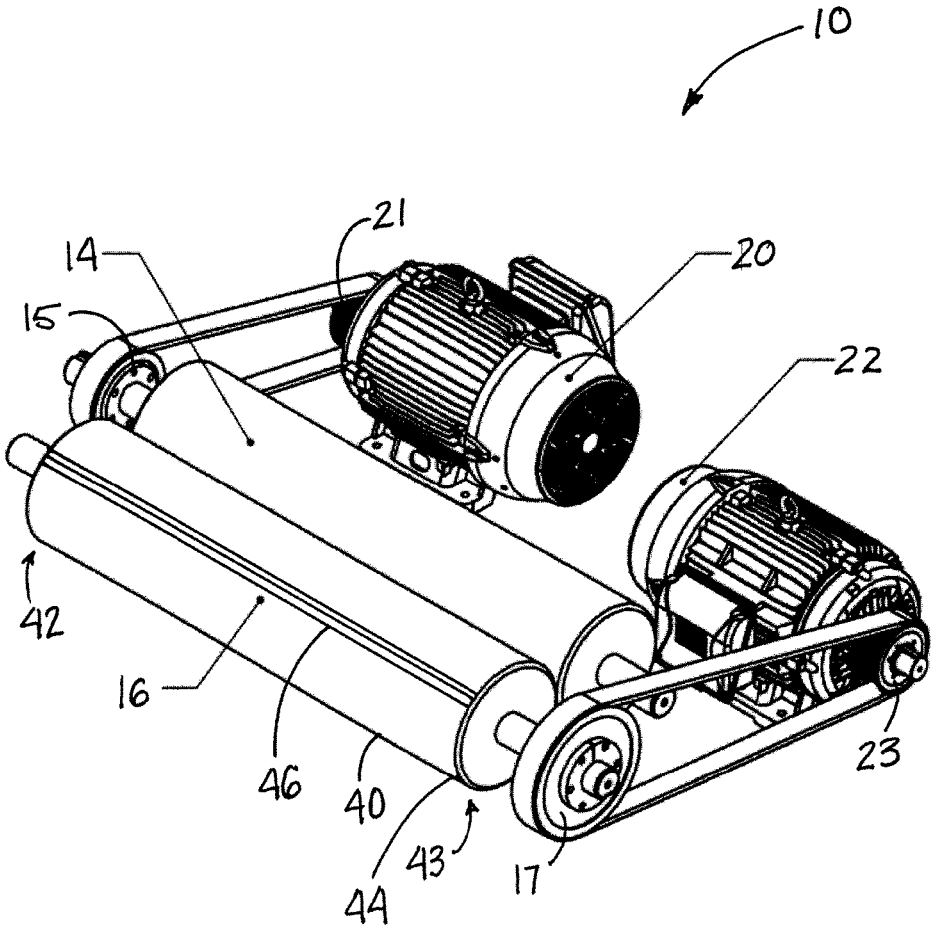
FIG. 1 is a schematic perspective view of selected elements of a new roller mill grinding apparatus with regenerative capability according to the present disclosure.
Figure 2:
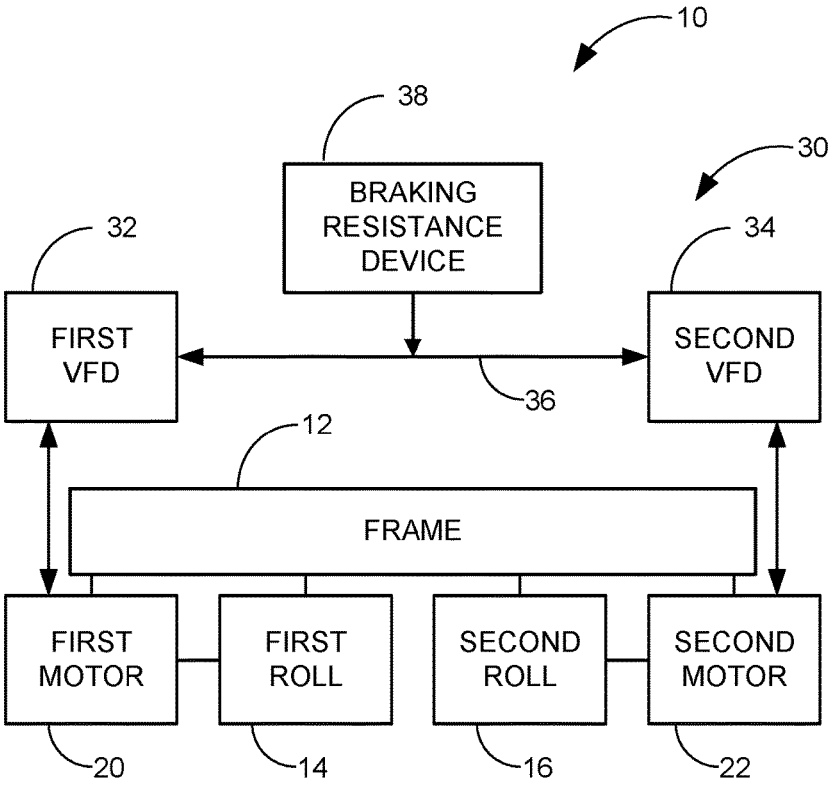
FIG. 2 is a schematic diagram of an illustrative embodiment of selected elements of the roller mill grinding apparatus.
Figure 3:
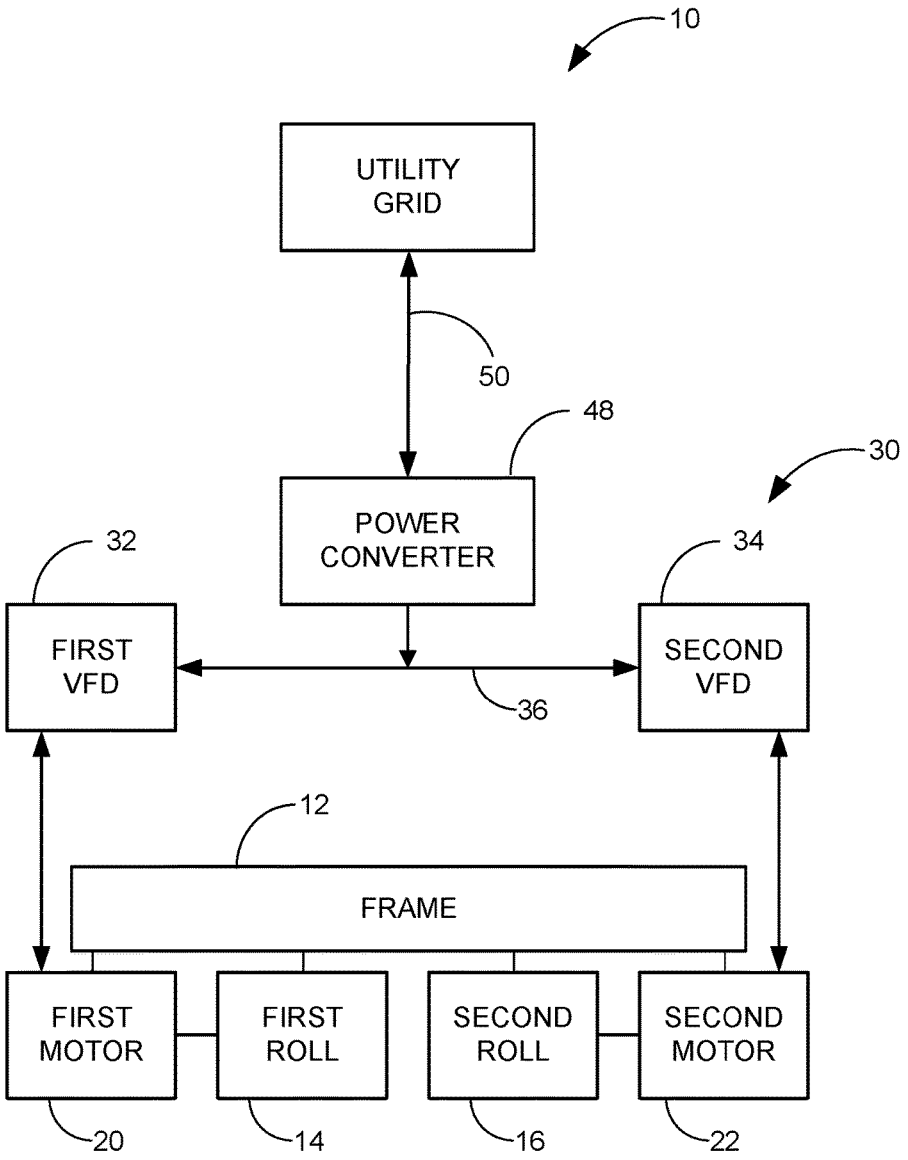
FIG. 3 is a schematic diagram of an optional configuration of the apparatus, according to an illustrative embodiment.
Figure 4:
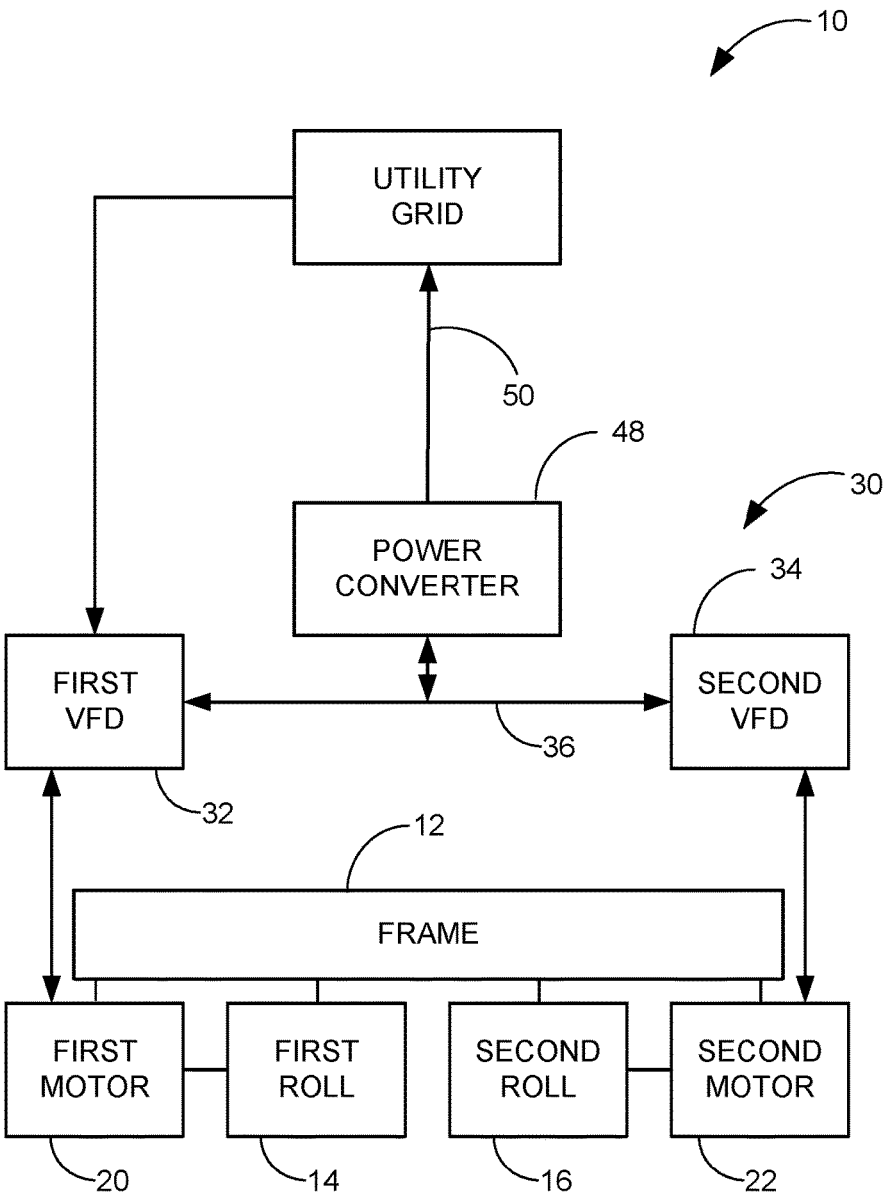
FIG. 4 is a schematic diagram of an optional configuration of the apparatus, according to an illustrative embodiment.

With reference now to the drawings, and in particular to FIGS. 1 through 6 thereof, a new roller mill grinding apparatus with regenerative capability embodying the principles and concepts of the disclosed subject matter will be described.

The applicants have recognized that one approach for generating a smaller or finer grind size of particles, particularly in finer grind sizes such as approximately 4900 microns to 100 microns (and in some cases approximately 2500 microns to approximately 200 microns), involves the imposition of a speed differential between a pair of rolls or rollers used to grind the particles in a gap therebetween. The speed differential between the rolls causes a shearing effect on the particles which generally produces a more uniform size distribution for the particles.

One significant challenge in producing the roll speed differential is the complicated belt wrap pattern required about the pulleys mounted on the rolls to control the speed differential of the rolls when a single motor is used to drive both rolls at the different speeds. A substantial degree of wrap of the drive belt about the roll pulleys is required to more accurately control the rotational speed differential during grinding. Typically, the pair of rolls is driven using a single motor and four pulleys, namely a pulley on the motor, a pulley on the relatively faster rotating roll, a pulley on the relatively slower rotating roll, and an idler pulley to create the necessary degree of wrap about the roll-mounted pulleys. This belt and pulley system is complicated and produces excessive loads on the shaft of the motor and thus increases the likelihood of a motor failure, especially in comparison to a much more preferable two pulley system in which one motor controls one roll.

When there is a rotational speed differential between the rolls, the shearing effect used to grind the particles may also tend to cause the faster rotating roll to start influencing or driving the slower rotating roll toward a speed that is faster than the speed desired to create the shearing effect for effective grinding, ultimately tending to cause the rolls to rotate at the same rotational speed as each other. This influencing effect is one of the reasons that the wrap of the belts on the pulleys has to be substantial.

The applicants have also recognized that the influencing of the slower speed roll may effectively convert the motor driving the relatively slower roll into a generator without an outlet to discharge the energy being generated. Without being able to discharge the energy being generated, the temperature of the motor tends to heat up and the motor is more likely to fail. The applicants have devised a regenerative braking system that acts to brake or slow the speed of the relatively slower roll to counteract the influence of the relatively faster roll and maintain the desired and suitable differential in rotational speeds of the rolls. The motor of the relatively slower roll may be used to generate electrical power as the relatively faster roll tends to spin the slower roll, and braking of the speed of the slower roll may be accomplished by applying an electrical load to the motor. Any power generated may then be utilized, for example, the system to power the motor rotating the faster roll.

In some embodiments, this functionality can be accomplished by creating a bus system between two variable frequency drives (VFDs) used to power the motors. A first, driving variable frequency drive (VFD) may provide power to a first, driving motor which drives or rotates the relatively faster first roll of the roller mill grinding apparatus and a second, driven variable frequency drive (VFD) may provide power to a second, driven motor rotating the relatively slower second roll. Under conditions in which the faster first roll does not drive the slower second roll to or above the desired slower rotational speed, such as when the particles don't require significant energy to grind, the driven motor is operated by the second VFD to provide the rotational motion to rotate the slower second roller to the desired slower speed. Under conditions where the faster first roll causes the slower second roll to rotate faster than the desired slower speed, the second motor is operated by the second VFD to act as a brake to slow the second roll to a rotational speed that is closer to the desired slower speed for the second roll. The energy derived from the braking may be transferred from the second motor, turning the second motor into a generator. The electrical energy derived from the second motor may be transferred on an electrical bus from the second VFD to the first VFD associated with the first motor to be reclaimed and used, for example, the drive the first motor.

Advantageously, the system may be able to use less electrical power overall due to the reclamation of at least some of the energy that would be lost to heat if the second, driven motor was driven by the faster first roll and first motor. Moreover, the speed differential between rolls is preserved. A four pulley arrangement with complicated belt wrap and excessive shaft loading is avoided, in favor of a two pulley arrangement with a separate motor for each roll, which reduces motor failures. Further, the simple pulley design permits the use of shorter belts having a longer life and less slippage, and less slippage tends to reduce the standard deviation of the sizes of the particles of the grind as the rolls are locked in at set speeds. Also, by utilizing a VFD for each roll, the adjustment of the rotational speed ratio of the rolls is facilitated and may be adjusted on the fly to help dial in the desired character of the grind being performed. In some embodiments, the system may also utilize a larger motor as the driving first motor and a smaller motor as the driven second motor.

Operationally, the system may be operated in at least a couple of different ways. In a first approach, the rolls may be separated and running at the respective speeds that produce the desired speed differential, and then the rolls may be brought together to the suitable gap for grinding such that the faster first roll tends to drive the slower second roll to the same speed. The braking may then be applied as the rotational speed of the second roll begins to exceed its desired rotational speed, and the second motor changes or flips from a mode of driving the second roll to a mode of being driven by the second roll and acting as a generator and braking the rotation to a degree. Another approach may be to start and operate the first motor to drive the first roll to the relatively faster speed, allow the rotation of the first roll to influence or drive the second roll up toward the rotational speed of the first roll, and then start the second motor in a braking mode to thus begin braking the second roll without a change in the mode of the second motor.

In one aspect, the roll grinding apparatus 10 may comprise a frame 12 and at least a pair of rolls 14, 16 which are rotatably mounted on the frame. The pair of rolls may include a first roll 14 and a second roll 16 which are positioned in proximity to each other to grind materials passing through a gap between the rolls. A first driven pulley 15 may be mounted on the first roll 14 to rotate with the first roll, and a second driven pulley 17 may be mounted on the second roll 16 to rotate with the second roll.

A pair of motors 20, 22 configured to rotate the rolls may include a first motor 20 and a second motor 22. The first motor 20 may be configured to rotate the first roll 14 and the second motor 22 may be configured to rotate the second roll 16. A first driver pulley 21 may be mounted on a rotating shaft of the first motor 20 and a first belt 24 may connect the first driver pulley 21 to the first driven pulley 15 on the first roll. A second driver pulley 23 may be mounted on a rotating shaft of the second motor 22 and a second belt 25 may connect the second driver pulley 23 to the second driven pulley 17 on the second roll. Although the description generally relates to a belt and pulley drive system, it should be recognized that other means of transferring the rotation between the motor and the roll may be suitably utilized. While in some embodiments the means for transferring the rotation may effect a reduction in rotational speed, such as a gearbox with suitably sized gears, other embodiments may utilize a coupling that provides substantially no change in the rotation speed between the motor and roll.

The apparatus 10 may also include a control apparatus 30 which is configured to control operation of the motors 20, 22, and thereby the rotation of the associated rolls. The control apparatus 30 may be in communication with each of the first 20 and second 22 motors, and may be configured to control the supply of electrical power to the first and second motors. The control apparatus may also be configured to sense the rotational speed of at least the first roll and may also sense the speed of the second roll. The control apparatus 30 may include a first power controller 32 configured to control the supply of electrical power to the first motor, and may also include a second power controller 34 which is configured to control the supply of electrical power to the second motor, and may also control power generated by the second motor in a regenerative mode. The first 32 and second 34 power controllers may each comprise, for example, a variable frequency drive (VFD). The control apparatus 30 may also include a bus 36 that electrically links the first power controller and the second power controller, and which may be a direct current (DC) bus. The control apparatus 30 may also include circuitry for providing braking of the second motor when the regenerative braking is not suitable or sufficient for slowing the speed of the second motor and second roll. The circuitry may include a dynamic braking resistance device 38 that may be configured to selectively apply resistance to the bus and reduce the power through the resistance provided by the device 38. Illustratively, the device 38 may include a pair of brake choppers (or brake transistors) that are wired in parallel with the bus connection between the first and second VFDs, and if the voltage level of the bus 36 rises to an unsafe or undesirable level, the brake choppers may activate or turn on to close a solid state switch so that excess energy can be safely dissipated by one or more dynamic braking resistors.

The control apparatus 30 may be configured to determine and/or maintain a target speed for each of the first and second rolls, or in some implementations determine and/or maintain a target speed differential between the first and second rolls, which may be input into the control apparatus by an operator, or other means. The first target speed for the first roll and the second target speed for the second roll may be such that the second target speed is less than the first target speed and the first roll is rotated at a faster speed than the second roll. The control apparatus may cause the first motor to rotate the first roll at the first target speed, and may cause the second motor to rotate the second roll at the second target speed, or at the selected speed differential with respect to the first target speed of the first roll. The control apparatus may sense a current speed of the second roll and compare the current speed of the second roll to the second target speed. In some implementations, sensing of the speed or speeds of the rolls may not be performed, and the speed may simply be determined by the amount of power supplied to the motor or motors, based upon a knowledge of the rotational speed produced per a given unit of characteristic of the power supplied. For example, speed control through the technique of "Volts per Hz" may be utilized.

The control apparatus may also cause the second motor to rotate the second roll at the second target speed by, if the current speed of the second roll is lower than the second target speed, providing electrical power to the second motor to increase the current speed of the second roll toward the second target speed. The providing of electrical power to increase the speed of the second motor may be caused by altering some characteristic of the power supplied to the second motor, such as, for example, by increasing the electrical frequency of power supplied to the second motor. If the current speed of the second roll is higher than the second target speed, the control apparatus may generate electrical power by the second motor as the second motor is driven by the second roll to thereby brake the second roll and decrease the current speed of the second roll toward the second target speed.

Each of the rolls 14, 16 may comprise a roll body 40 which may have a substantially cylindrical shape and may have opposite ends 42, 43. The roll body 40 may have a circumferential surface 44, and a plurality of teeth 46 may be formed on the circumferential surface. The teeth may extend from one end 42 to the other end 43 of the second of the roll body and the teeth may be substantially straight between the opposite ends. The teeth may also be substantially continuous between the opposite ends, although some interruptions may be utilized. Each of the rolls may also include a roll shaft which extends through the roll body and the roll shaft may have end portions which extend from the opposite ends 42, 43 of the roll body.

In operation, electrical utility power may be supplied to each of the first and second VFDs and the first and second motors respectively associated therewith to rotate the first and second rolls. When the first roll is driven by the first motor to its first target speed, the first roll may influence the second roll, and thereby the second motor, to rotate at a speed that is above or at the second motors desired synchronous speed determined by the controller, and may approximate the speed of the first roll and motor in some circumstances, and in these situations the second motor may begin to function as a generator. Greater force applied to the second roll by the first roll (e.g., via the materials being processed moving therebetween) may result in a greater degree of regeneration by the second motor. When the second motor is regenerating electrical power, the voltage of the bus of the second VFD may rise due to the capacitors of the VFD attempting to store the regenerated electrical energy. The bus electrically connects the second VFD to the first VFD to permit the transfer of the electrical energy back to the first VFD and the first motor to be used to power the first motor. For protection against high power conditions that might damage the VFDs and the motors, the dynamic braking resistance device 38 may activate to protect the circuitry under damaging conditions. Optionally, an additional form of protection may be provided against short circuits through the use of a fast acting device, such as of the semiconductor type, on both the positive and negative conductors of the DC bus.

Figure 6:
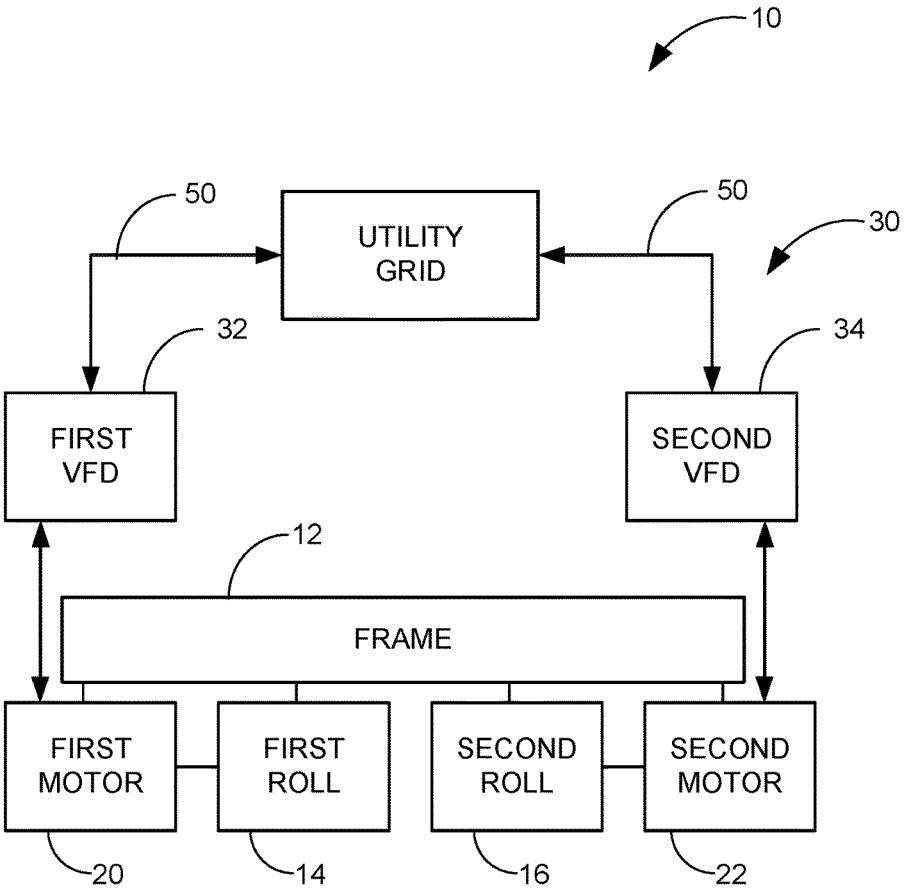
FIG. 6 is a schematic diagram of an optional configuration of the apparatus, according to an illustrative embodiment.

In some embodiments, the first and second VFDs may not be connected together in a power sense or a control sense, and may operate substantially independently of each other based upon target speeds for the respective rolls and independent connections to the utility power grid (see e.g., FIG. 6). In some implementations, the power generated by the second motor may be fed directly back to the electrical power utility, and may not directly reach the first VFD and motor. The flow of electrical power to and from the second motor (and second VFD) may depend if the second motor is driving, or being driven by, the second roll. A power converter 48 may make any necessary conversions in the power in order to feed the generated power to the utility line 50 (see, e.g., FIG. 3). Optionally, power may be fed directly (more or less) to the first VFD from the utility line, and power generated by either or both of the first and second motors may be converter and supplied back to the utility line (see FIG. 4) When the operation of the apparatus is to be stopped and power is no longer provided to either the first motor or the second motor, the decelerating rotation of the first and second rolls may be employed to generate power by both of the first and second motors. In some implementations, the power generated by the motors being driven by the decelerating rolls may be provided, for example, to the electrical power utility line after any necessary conversion of the power such as, for example, conversion from DC power on the bus to alternating current (AC) power for the utility grid.

As a further option, the speed of the first motor may not be controlled and the first motor (and the first roll) may be allowed to rotate at the normal or natural operational speed, and the speed of the second motor and roll may be controlled to maintain the desired speed differential between the rolls.

Figure 5:
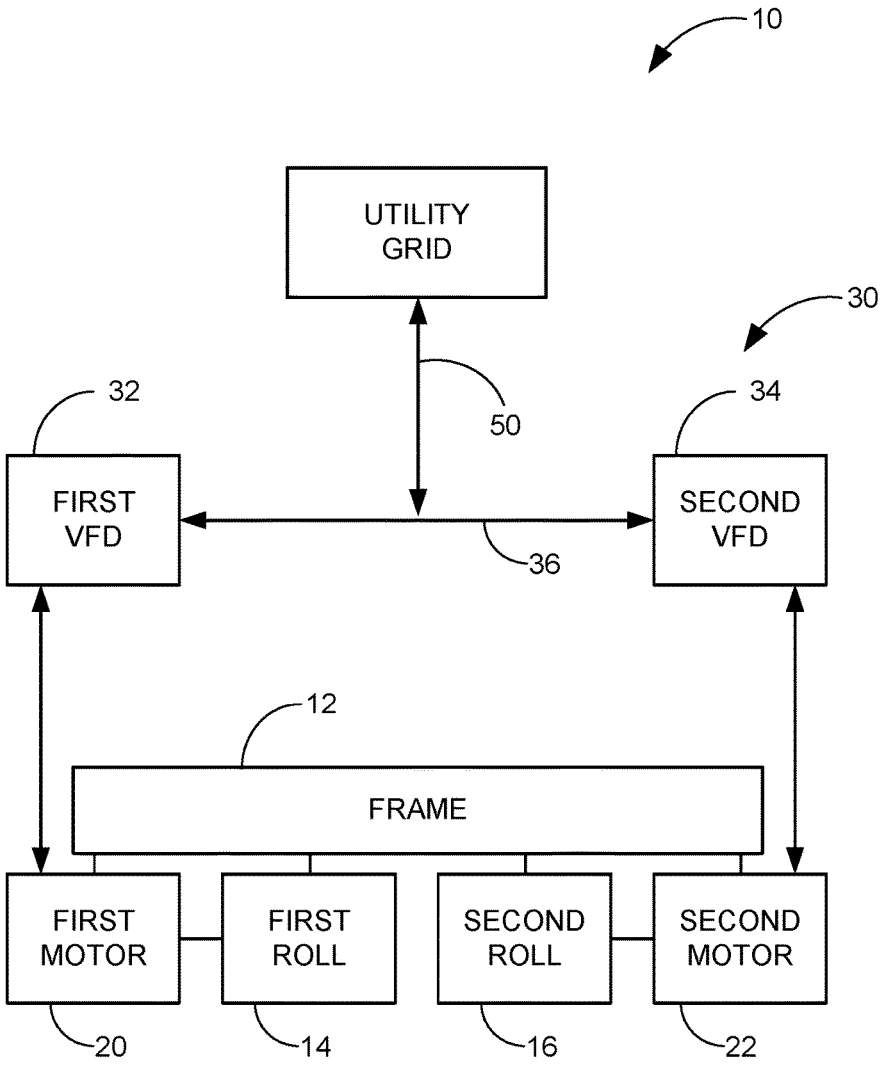
FIG. 5 is a schematic diagram of an optional configuration of the apparatus, according to an illustrative embodiment.

In other implementations, the electrical power may be taken directly from the utility supply to operate the first motor (as well as the second motor when needed) and any generated power may be fed directly back to the utility line when no conversion is needed or utilized (see FIG. 5).

It will be recognized that the techniques of the disclosure could be applied to a series of pairs of rolls (such as in a stacked arrangement), and the pairs of rolls may be pairs where it is desired to rotate one roll faster than the other roll, and power generated by one or more of the motors associated with one or more of the rolls may be used to power any of the other motors powering another roll.

Testing of apparatus similar to that described herein has demonstrated a significant increase in power use efficiency as compared to a similar roller mill grinding apparatus utilizing a single motor driving both rolls using four pulleys (one on the motor, one on each of the two rolls, and an idler pulley). Testing has shown that an apparatus using the disclosed elements and techniques may utilize approximately 15 percent to approximately 20 percent less kilowatt per ton of material ground by the apparatus. Another surprising result of testing shows a significant decrease in the standard deviation of the sizes of the particles produced from the desired particle size. Testing has shown that the standard deviation using the disclosed system, as compared to a conventional four pulley apparatus, was reduced from 2.1 to 1.79, based upon the formula for standard deviation suggested by Charles Stark and Julie Kalivoda of Kansas State University.

For the purposes of the foregoing description, the term "brake" is used in the sense of resisting rotational movement which may not result in a complete stoppage of the rotational movement.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A roll grinding apparatus comprising:

a frame;

a first roll and a second roll mounted on the frame and positioned in spaced proximity to each other to grind materials passing through a gap between the rolls;

a first motor configured to rotate the first roll and a second motor configured to rotate the second roll;

a control apparatus in communication with at least the second motor to control operation of the second motor through control of supply of electrical power to and from the second motor, the control apparatus being configured to:

determine a first target speed for the first roll and a second target speed for the second roll;

sense a current speed of the second roll;

compare the current speed of the second roll to the second target speed; and cause the second motor to rotate the second roll at the second target speed by:

if the current speed of the second roll is lower than the second target speed, increasing an amount of electrical power provided to the second motor to increase the current speed of the second roll; and if the current speed of the second roll is higher than the second target speed, then:

decreasing an amount of electrical power provided to the second motor such that the second motor discontinues driving rotation of the second roll and the second roll begins to drive rotation of the second motor to cause the second motor to generate electrical power; and applying the electrical power generated by the second motor to an electrical load to thereby function as a brake on rotation of the second roll and decrease the current speed of the second roll.

2. The apparatus of claim 1 wherein, if the current speed of the second roll is higher than the second target speed, the control apparatus causes the amount of electrical power provided to the second motor to be zero.

3. The apparatus of claim 1 wherein the second target speed is less than the first target speed.

4. The apparatus of claim 1 wherein the control apparatus comprises a first speed sensor configured to sense the rotational speed of at least the first roll and a second speed sensor configured to sense the rotational speed of at least the second roll.

5. The apparatus of claim 1 wherein determining the first and second target speeds includes determining a target speed differential between rotation of the first and second rolls.

6. The apparatus of claim 1 wherein the control apparatus is configured to cause the first motor to rotate the first roll at the first target speed to induce rotation of the second roll without providing electrical power to the second motor.

7. The apparatus of claim 1 additionally comprising a first driven pulley mounted on the first roll to rotate with the first roll, a second driven pulley mounted on the second roll to rotate with the second roll, a first driver pulley mounted on a rotating shaft of the first motor and a first belt connecting the first driver pulley to the first driven pulley on the first roll, and a second driver pulley mounted on a rotating shaft of the second motor and a second belt connecting the second driver pulley to the second driven pulley on the second roll.

8. The apparatus of claim 1 wherein the electrical load comprises the first motor rotating the first roll.

9. The apparatus of claim 1 wherein the electrical load comprises a dynamic braking resistance device configured to selectively apply resistance to power generated by the second motor via the control apparatus.

10. The apparatus of claim 1 wherein the electrical load is external to the roll grinding apparatus.

11. The apparatus of claim 1 additionally comprising adjusting, by the control apparatus, a magnitude of the electrical load applied to the second motor to produce a braking effect on rotation of the second motor and the second roll.

12. A method of operating a roll grinding apparatus having a frame, a first roll and a second roll rotatably mounted on the frame and positioned in proximity to each other to grind materials passing through a gap spacing between the rolls, a first motor configured to rotate the first roll and a second motor configured to rotate the second roll, and a control apparatus in communication with each of the first and second motors to control operation of the motors through control of supply of electrical power to the motors, the method comprising:

determining a target speed for each of the first and second rolls;

operating the first roll by supplying electrical power to the first motor;

determining a current speed of the second roll;

comparing the current speed of the second roll to the target speed for the second roll; and adjusting the speed of the second roll by:

if the current speed of the second roll is lower than the second target speed, operating the control apparatus in a first mode by increasing an amount of electrical power provided to the second motor to increase the current speed of the second roll; and if the current speed of the second roll is higher than the second target speed, operating the control apparatus in a second mode by:

decreasing an amount of electrical power provided to the second motor such that the second motor discontinues driving rotation of the second roll and rotation of the second roll caused by rotation of the first roll in proximity to the second roll drives rotation of the second motor to cause the second motor to generate electrical power; and applying the electrical power generated by the second motor to an electrical load so that the second motor resists rotation of the second roll and decreases the current speed of the second roll.

13. The method of claim 12 wherein, if the current speed of the second roll is higher than the second target speed, providing no electrical power to the second motor.

14. The method of claim 12 wherein the second target speed is less than the first target speed.

15. The method of claim 12 wherein determining the first and second target speeds includes determining a target speed differential between rotation of the first and second rolls.

16. The method of claim 12 including utilizing electrical power generated by the second motor to operate the first motor such that the first motor forms at least a portion of the electrical load.

17. The method of claim 12 including applying electrical power generated by the second motor to an electrical load external to the roll grinding apparatus.

18. A roll grinding apparatus comprising:

a frame;

a first roll and a second roll mounted on the frame and positioned in spaced proximity to each other to grind materials passing through a gap between the rolls;

a first motor configured to rotate the first roll and a second motor configured to rotate the second roll;

a control apparatus in communication with at least the second motors to control operation of the second motor through control of supply of electrical power to and from the second motor, the control apparatus being configured to:

determine a first target speed for the first roll and a second target speed for the second roll;

determine a current speed of the second roll;

compare the current speed of the second roll to the second target speed; and cause the second motor to rotate the second roll at the second target speed by:

if the current speed of the second roll is lower than the second target speed, operating the control apparatus in a first mode by increasing an amount of electrical power provided to the second motor to increase the current speed of the second roll; and if the current speed of the second roll is higher than the second target speed, operating the control apparatus in a second mode by:

decreasing an amount of electrical power provided to the second motor such that the second motor discontinues driving rotation of the second roll and the second roll begins to drive rotation of the second motor to cause the second motor to generate electrical power; and applying the electrical power generated by the second motor to an electrical load to thereby function as a brake on rotation of the second roll and decrease the current speed of the second roll.

* * * * *